United States Patent [19]

Teerman et al.

[11] Patent Number: 4,550,875

[45] Date of Patent: Nov. 5, 1985

[54] ELECTROMAGNETIC UNIT FUEL INJECTOR WITH PISTON ASSIST SOLENOID ACTUATED CONTROL VALVE

[75] Inventors: Richard F. Teerman, Wyoming; Russell H. Bosch, Grandville; Ricky C. Wirth, Alto, all of Mich.

[73] Assignee: General Motors Corporation, Detroit, Mich.

[21] Appl. No.: 638,274

[22] Filed: Aug. 6, 1984

[51] Int. Cl.[4] ..... F02M 47/00

[52] U.S. Cl. ..... 239/88; 239/125

[58] Field of Search ..... 239/88–91, 239/94, 93, 124, 125, 585

[56] References Cited

U.S. PATENT DOCUMENTS

| | | | |
|---|---|---|---|
| 4,129,253 | 12/1978 | Bader et al. | 239/88 |
| 4,392,612 | 7/1983 | Deckard et al. | 239/88 |
| 4,408,718 | 10/1983 | Wich | 239/88 |
| 4,463,900 | 8/1984 | Wich | 239/88 |
| 4,470,545 | 9/1984 | Deckard et al. | 239/88 |
| 4,482,094 | 11/1984 | Knape | 239/88 |
| 4,485,969 | 12/1984 | Deckard et al. | 239/88 |

OTHER PUBLICATIONS

Pending U.S. patent application Ser. No. 530,549 filed Sep. 9, 1983, in the name of John I. Deckard.

Pending U.S. patent application Ser. No. 595,694 filed Apr. 2, 1984 in the names of John I. Deckard; Richard R. Teerman and Russell H. Bosch.

*Primary Examiner*—Jeffrey V. Nase

*Assistant Examiner*—Michael J. Forman

*Attorney, Agent, or Firm*—Arthur N. Krein

[57] ABSTRACT

An electromagnetic unit fuel injector includes a pump assembly having an external actuated plunger reciprocable in a bushing with flow therefrom during a pump stroke being directed to a fuel injection nozzle of the assembly. Fuel flow from the pump can also flow through a passage means, containing a normally open, substantially pressure-balanced control valve actuated by a solenoid assembly in the valve closing direction to block drain flow during a pump stroke, as desired. A piston, actuated by discharge fuel pressure is operatively connected to the control valve to assist the solenoid in holding the control valve in a closed position.

5 Claims, 9 Drawing Figures

ELECTROMAGNETIC UNIT FUEL INJECTOR WITH PISTON ASSIST SOLENOID ACTUATED CONTROL VALVE

This invention relates to unit fuel injectors of the type used to inject fuel into the cylinders of a diesel engine and, in particular, to an electromagnetic unit fuel injector having a solenoid actuated, piston assisted control valve therein to control the start and end of fuel injection.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine-driven cam whereby to pressurize fuel to a suitable high pressure so as to effect the unseating of a pressure-actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect the unseating of the injection valve of the associated fuel injection nozzle. Exemplary embodiments of such an electromagnetic unit fuel injector are disclosed, for example, in U.S. Pat. No. 4,129,253, entitled, "Electromagnetic Unit Fuel Injector", issued Dec. 12, 1978, to Ernest Bader, Jr., John I. Deckard, and Dan B. Kuiper, and Pat. No. 4,392,612, same title, issued July 12, 1983, to John I. Deckard and Robert D. Straub.

Although the solenoid actuated control valve used in the unit injector disclosed in the above-identified Pat. No. 4,392,612 patent is designed to be a pressure-balanced type valve, it has now been discovered that, because of wear or possibly because of manufacturing tolerances and possibly the nonselective matching of these elements, the valve in operation can, in effect, be nonpressure-balanced, thus requiring increased solenoid forces to hold the valve in its closed position.

SUMMARY OF THE INVENTION

The present invention provides an electromgnetic unit fuel injector that includes a pump assembly having a plunger reciprocable in a bushing and operated, for example, by an engine-driven cam, with flow from the pump during a pump stroke of the plunger being directed to a fuel-injection nozzle assembly of the unit that contains a spring-biased, pressure-actuated injection valve therein for controlling flow out through the spray tip outlets of the injection nozzles. Fuel flow from the pump can also flow through a passage means, containing a normally open pressure-balanced control valve with balance piston means, to a fuel drain passage means. Fuel injection is regulated by the controlled energization of the solenoid-actuated, pressure-balanced control valve whereby it is operative to block flow from the pump to the fuel drain passage means during a pump stroke of the plunger so that the plunger is then permitted to intensify the pressure of fuel to a value to effect unseating of the injection valve. The pressure-balanced control valve, with balance piston means, is operative to eliminate or reduce the force required to be applied by the solenoid to the control valve to effect sealing against the high pressure in the passage means during a fuel-injection cycle.

It is therefore a primary object of this invention to provide an improved electromagnetic unit fuel injector that contains a solenoid-actuated, pressure-balanced control valve, with balance piston means, controlling injection whereby the solenoid need only operate against a fraction or none of the fluid pressure generated by the plunger for controlling the start and end of injection.

Another object of the invention is to provide an improved electromagnetic unit fuel injector having a solenoid-actuated, pressure-balanced control valve incorporated therein on the centerline of the pump plunger so that the high pressure volume of the pump chamber defined thereby is substantially reduced whereby the peak fluid pressure generated by the plunger will be increased. In addition, this integral configuration locates the control valve closer to the injector needle valve to effect faster closure of this needle valve.

Still another object of the invention is to provide an improved electromagnetic unit fuel injector having a solenoid-actuated, pressure-balanced, poppet type, control valve with a throttle orifice means associated therewith so that an intermediate fluid pressure acting on the head of the valve is used to accelerate the opening of the control valve whereby the duration of the end of fuel injection is reduced.

For a better understanding of the invention, as well as other objects and further features thereof, reference is made to the following detailed description of the invention to be read in connection with the accompanying drawings.

DESCRIPTION OF THE PREFERRED EMBODIMENT

Figure 1:
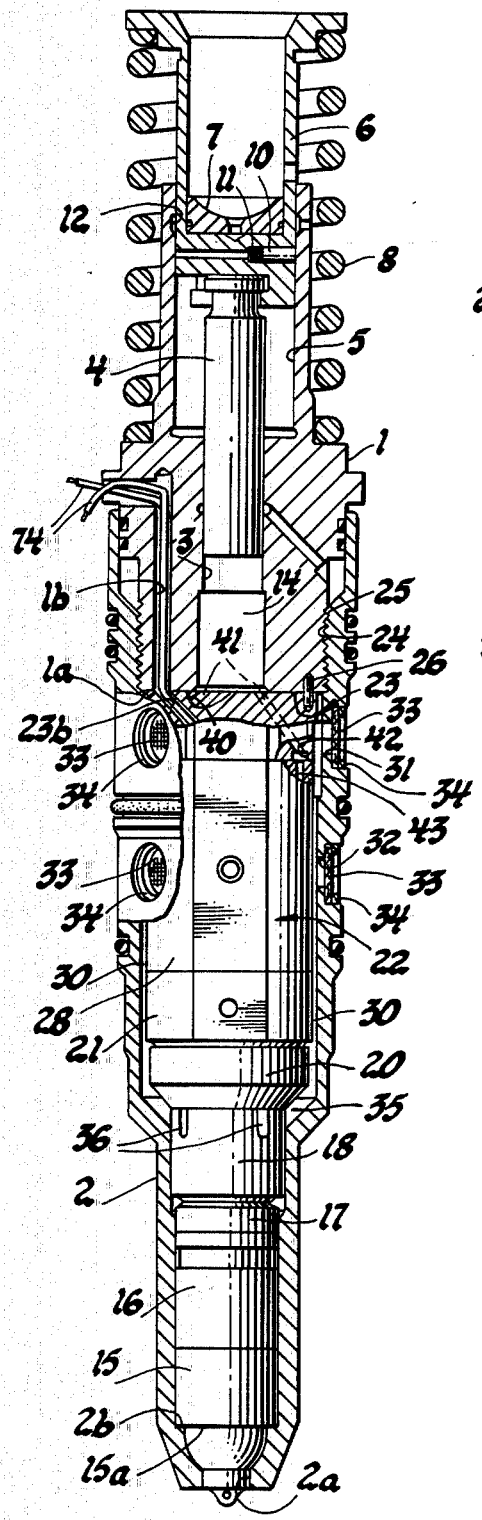
FIG. 1 is a longitudinal sectional view of an electromagnetic unit fuel injector in accordance with the invention with elements of the injector being shown so that the plunger of the pump thereof is positioned at the top of a pump stroke and with the electromagnetic valve means thereof energized, and with the lower internal parts of the assembly shown in elevation.
Figure 2:
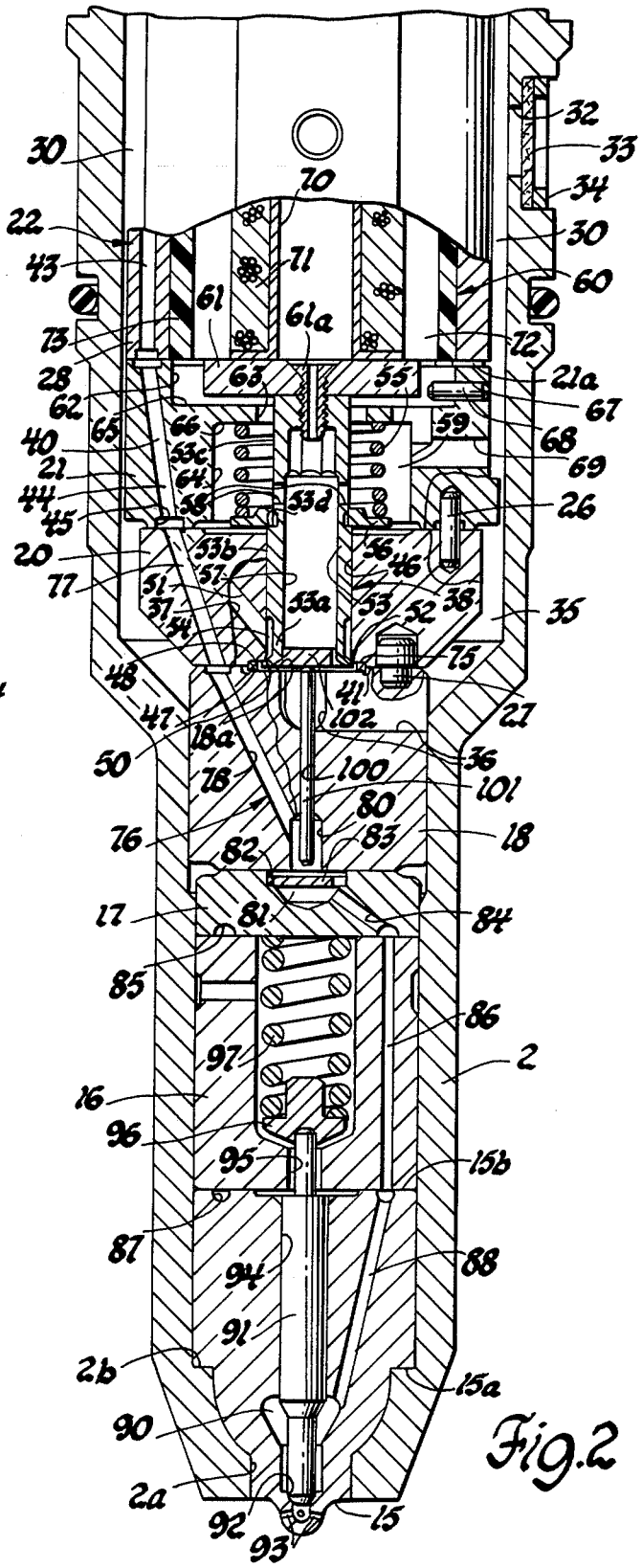
FIG. 2 is an enlarged longitudinal sectional view of the lower portion of the electromagnetic unit fuel injector of FIG. 1, with the control valve shown in its closed position.

Referring first to FIGS. 1 and 2 and in particular to FIG. 1, there is shown an electromagnetic unit fuel injector constructed in accordance with the invention, that is, in effect, a unit fuel injector-pump assembly with an electromagnetic actuated, piston assist, control valve incorporated therein to control fuel discharge from the injector portion of this assembly in a manner to be described in detail hereinafter.

In the construction illustrated, the electromagnetic unit fuel injector has an injector body that includes a pump body 1 and a nut 2 that is threaded to the lower end of the pump body 1 to form an extension thereof. In the embodiment shown, the nut 2 is formed of stepped external configuration and with suitable annular grooves to receive O-ring seals whereby it is adapted to be mounted in a suitable injector socket, not shown, provided for this purpose in the cylinder head of an internal combustion engine, both not shown, the arrangement being such whereby fuel can be supplied to and drained from the electromagnetic fuel injector via internal fuel rails or galleries suitably provided for this purpose in the cylinder head, not shown, in a manner known in the art.

As best seen in FIG. 1, the pump body 1 is provided with a stepped bore therethrough defining a cylindrical lower wall or bushing 3 to slidably receive a pump plunger 4 and an upper wall 5 of a larger internal diameter to slidably receive a cup-shaped plunger actuator follower 6 having a ball-socketed follower button 7 therein. The follower 6 extends out one end of the pump body 1 whereby it through its follower button 7 and the plunger 4 connected to the follower is adapted to be reciprocated by an engine driven element, and by a plunger return spring 8 in a conventional manner. A stop pin 10 slidable in a radial aperture in the follower 6 is biased by a spring 11 in a radial direction so that it can enter an annular stop groove 12 provided for this purpose in the pump body 1 whereby to limit upward travel of the follower 6.

The pump plunger 4 forms with the bushing 3 a pump chamber 14 at the lower open end of the bushing 3, as shown in FIG. 1.

As best seen in FIGS. 1 and 2, the nut 2 has an opening 2*a* at its lower end through which extends the lower end of a combined injector or spray tip valve body 15, hereinfter referred to as the spray tip, of a conventional fuel injection nozzle assembly. As conventional, the spray tip 15 is enlarged at its upper end to provide a shoulder 15*a* which seats on an internal shoulder 2*b* provided by the stepped through bore in nut 2.

Between the upper end of the spray tip 15 and the lower end of the pump body 1 there is positioned, in sequence starting from the spray tip, an injection valve spring cage 16, a check valve cage 17, a control valve stop/piston cage 18, a control valve cage 20, an armature spring cage 21, an electromagnetic stator assembly 22 and, a stator spacer 23, as shown in FIG. 1.

Nut 2, as shown in FIG. 1, is provided with internal threads 24 for mating engagement with the external threads 25 at the lower end of the pump body 1. The threaded connection of the nut 2 to pump body 1 holds the spray tip 15, spring cage 16, valve cage 17, the control valve stop/piston cage 18, control valve cage 20, armature spring cage 21, stator assembly 22 and stator spacer 23 clamped and stacked end-to-end between the upper face 15*b* of the spray tip 15 an the bottom face 1*a* of the pump body 1. All of these above-described elements have lapped mating surfaces whereby they are held in pressure sealed relationship to each other.

In addition, angular orientation of the stator spacer 23, stator assembly 22, armature spring cage 21 and the control valve cage 20 with respect to the pump body 1 and to each other is maintained by means of alignment pins 26 positioned in suitable apertures in a conventional manner, only one such pin being shown in each of FIGS. 1 and 2. In a similar manner, the control valve stop/piston cage 18 is angularly positioned relative to the control valve cage 20 by means of one or more stepped alignment pins 27 positioned in suitable apertures provided for this purpose in the opposed faces of these elements, as shown in FIG. 2.

Figure 5:
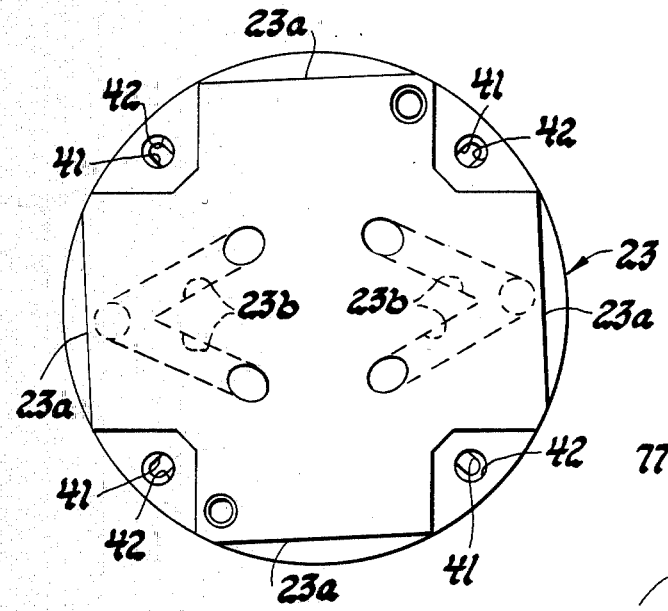
FIG. 5 is an enlarged bottom view of the stator spacer, per se, of the unit injector.

As shown in FIGS. 1, 2, and 5, the lower end of the stator spacer 23, the cage or housing 28 of the stator assembly 22 and the armature spring cage 21 each have the exterior surface thereof provided with flats, four such circumferentially spaced apart flats being used in the embodiment shown, whereby to define with the interior surface of the nut 2, axial extending supply/-drain passages 30. Only two such passages are shown in the FIGS. 1 and 2, but the four flats 23*a* on the stator spacer 23 are shown in FIG. 5.

Fuel is supplied to and drained from the supply/drain passages 30 by means of two sets of circumferentially spaced apart stepped radial inlet ports 31 and drain ports 32 provided in the wall of the nut 2 and which are axially spaced apart a predetermined distance for flow communication with, for example, an upper fuel supply rail and a lower fuel drain rail, respectively, provided in the cylinder head of an engine. In the embodiment shown, the nut 2 is provided with five each of such radial ports 31 and 32 with each having a fuel filter 33 positioned therein that is retained by means of a ring-like filter retainer 34 suitably fixed, as by staking in an associate radial port.

Figure 3:
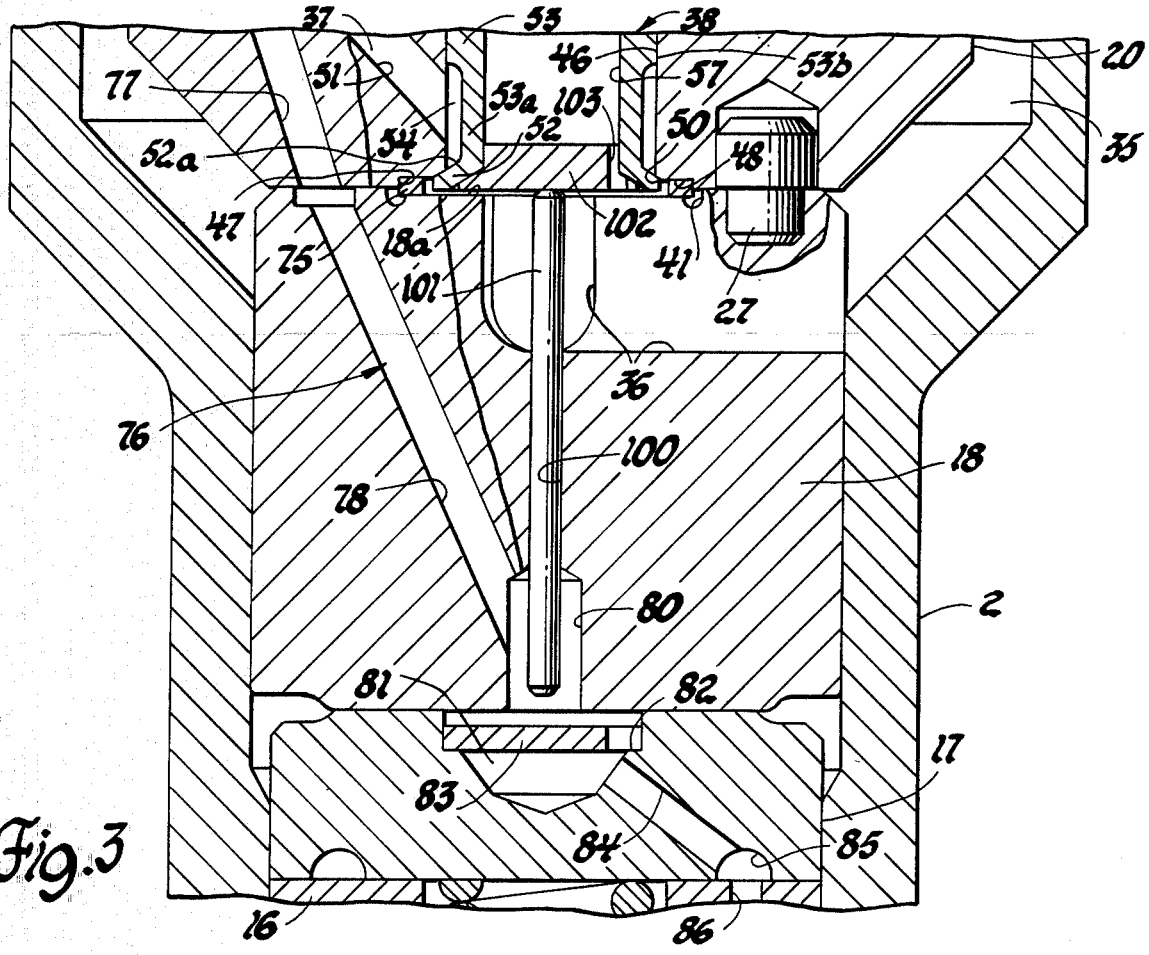
FIG. 3 is an enlarged sectional view of a portion of the control valve cage, the control valve stop/piston cage portions of the asembly of FIG. 2, with the valve assist piston shown in elevation.

As illustrated in FIGS. 1, 2 and 3, the control valve cage 20, which is of reduced exterior diameter relative to the surrounding internal wall diameter of the nut 2, and the upper end of the control valve stop/piston cage 18 extending up into this wall portion of the nut 2 defines therewith the upper, annulus-shaped portion of a supply/drain chamber 35 that is in flow communication with the lower ends of the supply/drain passages 30. This supply/drain chamber 35 at its lower end is defined in part by a crossed pair of radial through slots 36 provided in the upper end of the control valve stop/piston cage 18, as best seen in FIGS. 2 and 3.

The supply/drain chamber 35 and the pump chamber 14 are in flow communication with each other via a supply/spill passage means, generally designated 37, that extends from the supply/drain chamber 35 so as to interconnect with a supply/discharge passage means 40 that opens at one end into the pump chamber 14, with flow through the supply/spill passage means 37 being controlled by a solenoid actuated, piston assist, pressure balanced control valve 38, (FIGS. 2, 3 and 4) all to be described in detail hereinafter.

Referring now first to the supply/discharge passage means 40, the upper end of this passage means, in the construction shown and as best seen in FIGS. 1 and 5, is defined by a plurality of inclined through passages 41 formed in the stator spacer 23 so that their upper ends open into the pump chamber 14 while their lower ends open into a counterbored annular cavities 42 formed in the lower face of the stator spacer 23. As shown in FIG. 5, four such passages 41 and cavities 42 are provided in the stator spacer 23 in the embodiment illustrated. The cavities 42 are, in turn, in flow communication with axially aligned, circumferentially spaced apart, stepped bore passages 43 extending through the stator housing 28 and which are each aligned at their lower ends with one of the inclined stepped bore passages 44 that extend through the armature spring cage 21 so as to be in flow communication with an annular groove 45 provided in the lower surface of this armature spring cage 21, as best seen in FIG. 2. In the embodiment shown, there are four each of such passages 43 and 44, with only one each being shown in FIG. 2.

Referring now to the control valve cage 20, as best seen in FIGS. 2, 3, 6, 7 and 8, it is provided with an axial stepped through bore defining an internal, cylindrical upper valve guide wall 46 and a lower wall 47 of larger internal diameter than valve guide wall 46, with the wall 46 and 47 being interconnected by a flat shoulder 48 terminating at a conical valve seat 50 encircling valve guide wall 46. In addition, the control valve cage 20 is provide with circumferentially spaced apart, inclined supply/drain passages 51 which at one end, the upper end with reference to FIG. 2, are in flow communication with the annular groove 45 and, which at their opposite end open through the valve guide wall 46 at a location next adjacent to and above the valve seat 50.

Fuel flow between the supply/drain chamber 35 and the supply/drain passages 51 is controlled by means of the control valve 38 which is referred to as a pressure balanced valve of the type disclosed in the above-identified U.S. Pat. No. 4,392,612, and which is in the form of a hollow poppet valve. The control valve 38 includes a head 52 with a conical valve seat surface **52*a* thereon, and a stem 53 extending upward therefrom. The stem 53 includes a first stem portion 53*a* of reduced diameter next adjacent to the head 52 and of an axial extent so as to form with the guide wall 46 an annulus cavity 54 that is always in fuel communication with the supply/drain passages 51 during opening and closing movement of the control valve, the annulus cavity 54 and the supply/drain passages 51 thus defining the supply/spill passages means 37. The stem 53 also includes a guide stem portion 53*b* of a diameter to be slidably guided in the valve stem guide wall 46, and an upper reduced diameter portion 53*c* that extends axially through a stepped bore in the armature/valve spring cage 21. Stem portions 53*b* and 53*c* are interconnected by a flat shoulder 53*d***.

Figure 4:
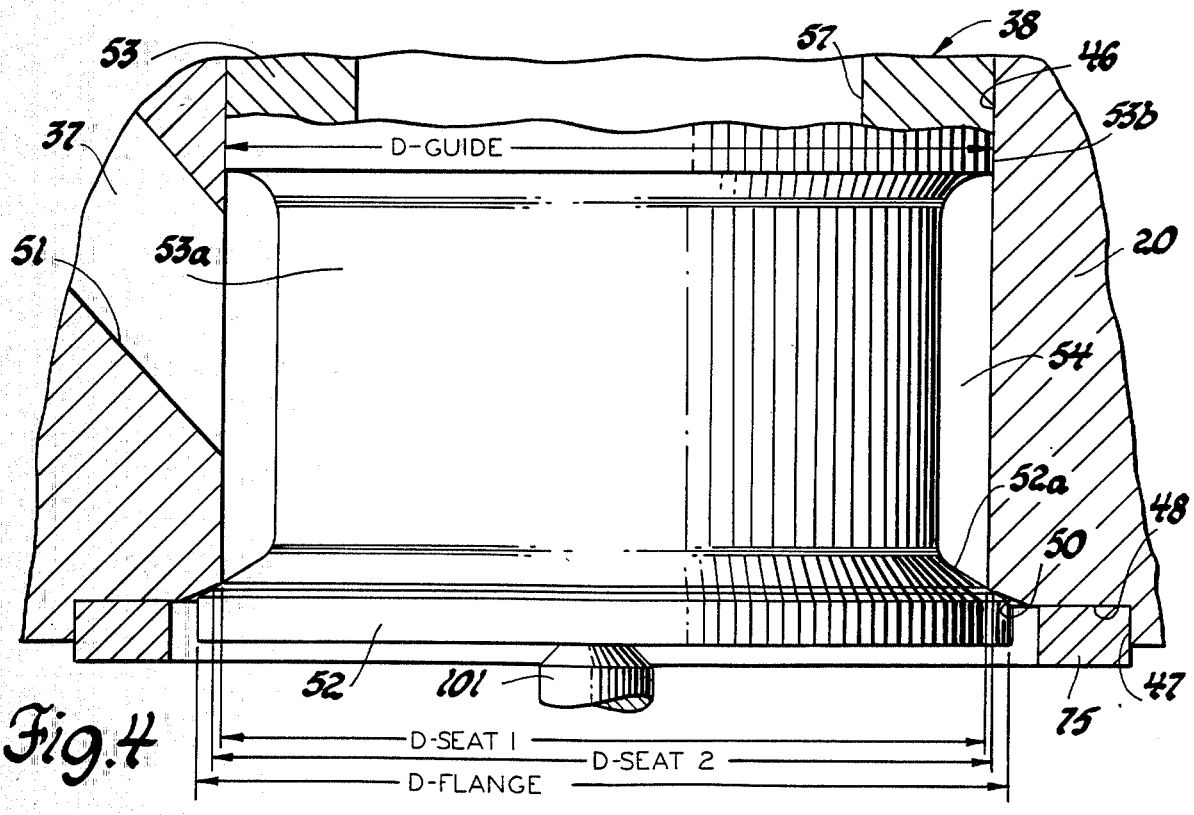
FIG. 4 is an enlarged cross-sectional view of a portion of the control valve and mating female seat portion of the valve assembly, per se, of FIGS. 2 and 3 showing the relative dimensions of these elements.

The control valve 38 is normally biased in a valve opening direction, downward with reference to FIGS. 2, 3 and 4, by means of a coil spring 55 loosely encircling the portion **53*c* of the valve stem 53. As shown, one end of the spring 55 abuts against a washer-like spring retainer 56 encircling stem portion 53*c* so as to abut against shoulder 53*d*. The other end of spring 55 abuts against an apertured internal shoulder 66 of the armature spring cage 21**.

In addition, the head 52 and stem 53 of the control valve 38 are provided with a stepped blind bore so as to materially reduce the weight of this valve and so as to define a pressure relief passage 57 of a suitable axial extent whereby at its upper end it can be placed in fluid communication via radial ports 58 with a valve spring cavity 59 in the armature spring cage 21, as best seen in FIG. 2, and also through a central through aperture, not numbered, in the screw **61*a* used to secure an armature 61, to be described next hereinafter, to the control valve 38. The aperture in screw 61*a* permits fuel flow therethrough to help reduce viscous damping and spill pressure may force fuel into the airgap, to be described hereinafter, to also assist in more rapid opening of the control valve 38**.

Movement of the control valve 38 in valve closing direction, upward with reference to FIG. 2 to the position shown, is effected by means of a solenoid assembly 60, which includes a rectangular shaped flat armature 61, fixed as by a flat head screw **61*a* to the upper closed end of the stem 53 of control valve 38**.

As best seen in FIG. 2, the armature spring cage 21 is provided with a stepped through bore which defines an upper wall 62 of a size to loosely receive the armature 61, an intermediate wall 63 of a diameter to loosely receive the stem 53 of the control valve 38 and a lower wall 64 of a diameter to loosely receive the spring 55 and spring retainer 56. Walls 62 and 63 are interconnected by a flat shoulder 65 which forms with the wall 62 an armature cavity for the armature 61 while walls 63 and 64 are interconnected by a flat shoulder 66 against which the upper end of spring 55 abuts.

A radial opening 67 which opens through wall 62 of the armature spring cage 21 has an armature spin stop pin 68 extending therethrough and positioned so as to prevent rotation of the armature 61. In addition, one or more radial ports 69 open through the lower wall 64 to provide for fluid communication between the cavity containing the spring 55 and the adjacent supply/drain passages 30. Also, as shown, the outer upper peripheral surface of the armature spring cage is provide with spaced apart recessed portions **21*a* to define with the lower surface of the stator assembly 22** a number of passages to permit flow between the supply/drain passages and the armature cavity.

As best seen in FIG. 2, the solenoid assembly also includes the stator assembly 22 having the tubular outer stator housing 28. A coil bobbin 70 supporting a wound stator or solenoid coil 71 and a multi-piece pole piece 72 are supported within the stator housing 28 by a retainer 73 made, for example, of a suitable plastic, with the lower surface of the pole piece 72 aligned with the lower surface of the stator housing.

The total axial extent of the armature spring cage 21 and control valve cage 20 is selected relative to the axial extent of the control valve 38 and armature 61 so that, when the control valve 38 is in the closed position, the position shown in FIG. 2, a preselected clearance will exist between the opposed working surfaces of the armature 61 and of the pole piece 72 whereby a minimum fixed air gap will exist between these surfaces.

The solenoid coil 71 is connectable, by electrical conductors 74 extending through suitable apertures **23*b* and 1*b* provided for this purpose in the stator spacer 23 and pump body 1, respectively, to a suitable source of electrical power via a fuel injection electronic control circuit, not shown, whereby the solenoid coil can be energized as a function of the operating conditions of an engine in a manner well known in the art. In the construction of the stator spacer 23 shown in FIG. 5**, four such apertures 23*b* are provided, although only two are used to carry the pair of conductors 74 in the embodiment illustrated.

Maximum opening movement of the control valve 38 is limited by means of the control valve stop/piston cage 18. For this purpose and as best seen in FIGS. 2 and 3, the upper surface of the control valve stop/piston cage 18 is suitably countersunk in the center theref so as to provide a stop surface 18*a* for limiting travel of the control valve 38 in a valve opening direction. As best seen in FIGS. 2, 3 and 4, a washer 75 located by the lower wall 47 of the control valve cage 20 is sandwiched between the shoulder 48 of this cage and the stop surface 18*a* in position to loosely encircle the head 52 of the control valve 38 and to define therewith a throttle orifice forming an upper annulus portion, of predetermined flow area, of the supply/drain chamber 35.

Figure 9:
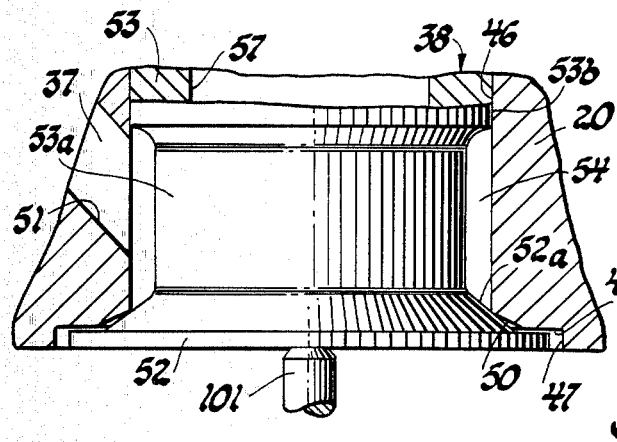
FIG. 9 is a view similar to FIG. 4 but showing a preferred control valve head and cooperating control valve cage seat portion, per se, with the control valve shown in the closed position.

If desired, the washer 75 may be eliminated and instead, as shown in the preferred alternate embodiment illustrated in FIG. 9, the outside diameter of the flanged end of the head 52 of the control valve 38 can be enlarged, as desired, whereby it will define with the lower wall 47 a corresponding throttle orifice portion of the supply/drain chamber 35 when the control valve is in an opening position.

During a pump stroke of the plunger 4, fuel is adapted to be discharged from the pump chamber 14 through the supply/discharge passage means 40 into the inlet end of a discharge passage means 76 to be described next hereinafter.

Figure 6:
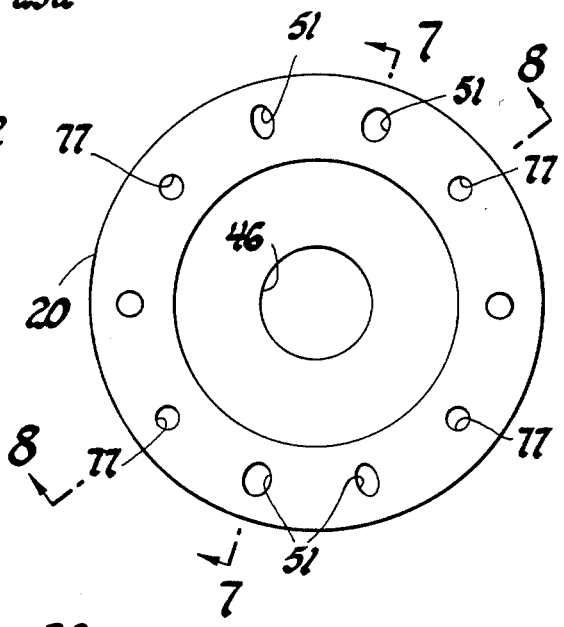
FIG. 6 is a top view of the control valve cage, per se, of the unit injector.
Figure 7:
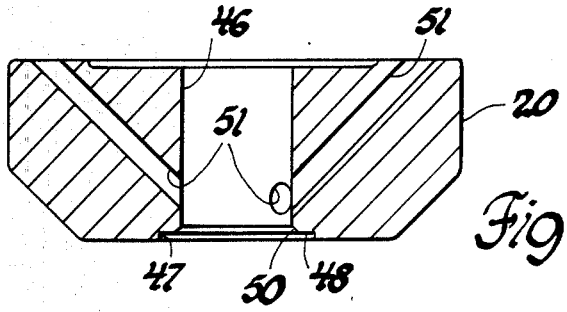
FIG. 7 is a cross-sectional view of the control valve cage, per se, taken along line 7—7 of FIG. 6.
Figure 8:
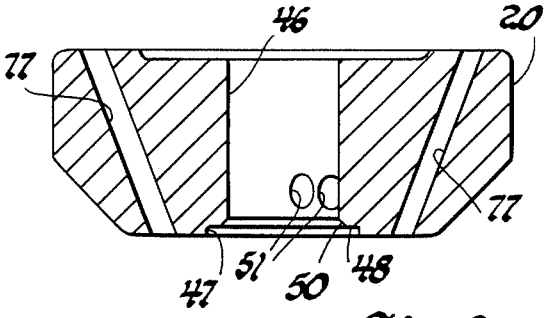
FIG. 8 is a cross-sectional view of the control valve cage, per se, taken along line 8—8 of FIG. 6.

An upper part of this discharge passage means 76, with reference to FIGS. 2, 6 and 8, includes inclined passages 77 provided in the control valve cage 20 so as to be in flow communication at one end with the groove 45 in the lower surface of the armature spring cage 21 and at their opposite ends with the countersunk upper ends of inclined passages 78 formed in the control valve stop/piston cage 18. The passages 78 are located so that the opposite ends thereof open into a central pressure chamber 80 formed by the enlarged lower portion of a stepped bore that extends axially through the control valve stop/piston cage 18 provided in accordance with a feature of the invention for a purpose to be described hereinafter.

As shown in FIGS. 2 and 3, the check valve cage 17, which also serves as a spring retainer, is provided with an enlarged, stepped chamber 81 formed therein so as to face the pressure chamber 80 and formed as a wall of the chamber 81 is an annular shoulder 82 which defines a stop for a flat check valve 83 having a scalloped outer peripheral portion. The chamber 81 extends laterally beyond the extremities of the opening defining the lower end of the pressure chamber 80 whereby the lower end surface of the control valve stop/piston cage 18 will form a seat for the check valve 83 when it is moved upward from the open position shown in these Figures to close the opening defining the lower end of the pressure chamber 80.

As shown in FIG. 2, at least one inclined passage 84 is also provided in the check valve cage 17 to connect the chamber 81 with an annular groove 85 in the lower end of this cage. This groove 85 is, in turn, in flow communication with one or more longitudinal passages 86 through the spring cage 16. The lower ends of each passage 86 is, in turn, connected by an annular groove 87 in the upper end of the spray tip 15 with at least one inclined passage 88 to a central passage 90 surrounding a conventional injection needle valve 91 movably positioned within the spray tip 15. At the lower end of passage 90 is an outlet for fuel delivery with an encircling tapered annular seat 92 for the needle valve 91 and, below the valve seat are one or more connecting spray orifices 93 located in the lower end of the spray tip 15.

The upper end of spray tip 15 is provided with a bore 94 for guiding opening and closing movements of the needle valve 91. A reduced diameter upper end portion of the needle valve 91 extends through the central opening 95 in the spring cage 16, of conventional construction, and abuts against a spring seat 96. Compressed between the spring seat 96 and the check valve cage 17 is a coil spring 97 which normally biases the needle valve 91 to its closed position shown.

Now, in accordance with a feature of the invention and as best seen in FIGS. 2 and 3, the stepped bore in the control valve stop/piston 18 that defines the pressure chamber 80 also defines a bushing 100 which slidably receives a piston 101 of predetermined diameter and of an axial length whereby one end thereof, the lower end with reference to FIGS. 2 and 3, extends into the pressure chamber 80 so as to be subjected to the pressure of fuel therein. The piston 101, at its opposite end, extends through the supply/drain chamber 35 so as to abut against a piston seat 102, of scalloped 103 outer peripheral configuration, that is suitably secured within the head 52 of the control valve 38 so as to be flush with the lower surface thereof.

The piston 101, as thus arranged, is operative to assist the solenoid assembly 60 in maintaining the control valve 38 closed relative to the valve seat 50 during an injection cycle in a manner to be described hereinafter.

Functional Description

Referring now in particular to FIGS. 1 and 2, during engine operation, fuel from a fuel tank, not shown, is supplied, at a predetermined supply pressure, by a pump, not shown, to the subject electromagnetic unit fuel injector through a supply passage and annulus, not shown, in flow communication with the radial inlet ports 31. Fuel, as delivered through the inlet ports 31, flows into the supply/drain passage 30 and then into the supply/drain chamber 35, including the portion thereof defined by the slots 36.

When the stator coil 71 of the stator assembly 22 is deenergized, the spring 55 is operative to open and hold open the control valve 38 such that the valve seat 50 and the head of the valve 38 will define a flow annulus. At the same time the armature 61, as connected to control valve 38, is also moved downward, with reference to FIG. 2, relative to the pole piece 72 whereby to establish a predetermined working air gap between the opposed working surfaces of these elements.

With the control valve 38 in its open position, fuel can flow from the supply/drain chamber 35 through the flow annulus between the valve head 52 and the inner wall of the washer 75 into the annulus cavity 54 and then via passages 51 and the supply/discharge passage means 40 into the pump chamber 14. Thus during a suction stroke of the plunger 4, the pump chamber will be resupplied with fuel. At the same time, fuel will be present in the discharge passage means 76 used to supply fuel to the injection nozzle assembly.

Thereafter, as the follower 6 is driven downward, as by a cam-actuated rocker arm in a manner well known in the art, to effect downward movement of the plunger 4, this downward movement of the plunger will cause fuel to be displaced from the pump chamber 14 and will cause the pressure of the fuel in this chamber and the adjacent supply/discharge passages means 40 connected thereto to increase. However, with the stator coil 71 still deenergized, this pressure can only rise to a level that is a predetermined amount less than the "pop" pressure required to lift the needle valve 91 against the force of its associate return spring 97.

During this period of time, the fuel displaced from the pump chamber 14 can flow via the supply/spill passage means including the annulus cavity 54, back into the supply/drain chamber 35 and then from this chamber the fuel can be discharged via the supply/drain passages 30 and drain ports 32, for return, for example, via an annulus and passage, not shown, back to, for example, the engine fuel tank containing fuel at substantially atmospheric pressure.

As is conventional in the diesel fuel injection art, a number of electromagnetic unit fuel injectors can be connected in parallel to a common drain passage, not shown, which normally contains an orifice passage therein, not shown, used to control the rate of fuel flow through the drain passage whereby to permit fuel pressure at a predetermined supply pressure to be maintained in each of the injectors.

Thereafter, during the continued downward stroke of the plunger 4, an electrical (current) pulse of finite characteristic and duration (time relative, for example, to the top dead center of the associate engine piston position with respect to the camshaft and rocker arm linkage) supplied through suitable electrical conductors 74 to the stator coil 71 produces an electromagnetic field attracting the armture 61 to effect its movement toward the pole piece 72.

This upward movement, with reference to FIG. 2, of the armature 61 as coupled to the control valve 35, will effect closing of the control valve 38 against the valve seat 50, the position of these elements shown in FIGS. 2, 3 and 4. As this occurs, the drainage of fuel via the supply/drain passage 51 and the annulus cavity 54 will no longer occur and this then permits the plunger 4 to increase the pressure of fuel in the discharge passage means 76, to a "pop" pressure level to effect unseating of the needle valve 91. This then permits the injection of fuel out through the spray orifices 93. Normally, the injection pressure increases during further continued downward movement of the plunger.

The control valve 38 has been referred to herein as being a pressure balanced valve, that is, it is a type of valve having the angle of its valve seat surface 52*a* selected relative to the angle of the valve seat 50 so that its seating engagement on the valve seat will occur at the edge interconnection of this valve seat 50 and the valve guide wall 46. The diameter of this desired annular seat contact, for pressure balancing of the control valve 38, is identified as in FIG. 4 D-SEAT 1. Accordingly, the inside diameter of the valve guide wall 46 and the outside diameter of the valve stem 53 form a sliding seal at the upper end of the annulus cavity 54. Thus, for practical purposes, D-SEAT 1=D-GUIDE, with reference to FIG. 4. With this arrangement, when the control valve 38 is in its closed position during the injection cycle, the pressure of fuel within the annulus cavity 54 will act against opposed surfaces of the valve which are, for practical purposes, of equal value.

However, in actual practice as a result of either seat wear or as a result of manufacturing tolerances and/or possible incorrect selective fitting of a control valve 38 with a control valve cage 20, the actual seating diameter D-SEAT 2, as shown in FIG. 4, can be slightly larger, within predetermined limits, than the desired seating diameter D-SEAT 1. This thus provides a differential area against which the pressure of fuel within the annulus cavity 54 can act, thereby resulting in a greater force being applied against the valve head 52 in a valve opening direction which, in the prior art, would have to be overcome by the attractive force of the associate solenoid assembly.

However, with the piston 101 arrangement of the invention, during the fuel injection cycle, fuel, at the high injection pressure present in the pressure chamber 80 will simultaneously operate on the lower end of the piston 101. Since the piston 101 which is of a predetermined external diameter and therefore has a predetermined lower end area, the fuel pressure will act on this piston in an upward direction with reference to FIGS. 2, 3 and 4. This upward force on the piston 101 is transmitted to the control valve 38 via the piston seat 102 fixed to the valve. The above referenced predetermined diameter of the piston 101 is selected so that, preferably, the net static force on the control valve 38 during the fuel injection cycle will be substantially zero.

With this arrangement, the previously required electromagnetic attractive force produced by the pole piece 72 on armature 61 in a particular unit injector application can be reduced, allowing a reduced working area of the air-gap and a reduced stator assembly 22 size and armature 61 size thus permitting greater miniaturization of the unit injector for a given engine application.

Ending the current pulse to the stator coil 71 causes the electromagnetic field to collapse, allowing the spring 55 to again open the control valve 38 and to also move the armature 61 to its lowered position. Opening of the control valve 38 again permits fuel flow via the supply/drain passages 51, the annulus cavity 54, the seat flow annulus between the valve seat 50 and now unseated valve seat surface 52 and the throttle orifice annulus defined, for example, by the outer peripheral surface of the valve head 52 and the internal wall of the washer 75, with reference to the embodiment shown in FIGS. 2–4, into the supply/drain chamber 35. The throttle orifice annulus throttles this drainage flow of fuel, thereby producing an intermediate pressure between the washer flow annulus and the seat flow annulus. This increases the pressure operating on the head of the control valve 38 through a seat area defined by the head diameter D-SEAT 1 and D-FLANGE, as shown in FIG. 4 embodiment, in a downward valve opening direction. This, in turn, effects a rapid control valve 38 opening and release of the system pressure in the discharge passage means 76 whereby the valve return spring 97 can again effect closure of the needle valve 91 sooner than would be possible without the presence of the throttle orifice. It will be appreciated that in the FIG. 9 embodiment, the increased head 52 area of the embodiment of the control valve 38 shown will further aid in the rapid opening movement of the control valve.

While the invention has been described with reference to the structure disclosed herein, it is not confined to the specific details set forth, since it is apparent that various modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. An electromagnetic unit fuel injector includes a housing means having a fuel passage means connectable to a source of fuel for the ingress or egress of fuel at a suitable supply pressure, a supply/drain chamber in flow communication with said fuel passage means, a valve stem guide bore in said housing means with a conical valve seat encircling said guide bore at the supply/drain chamber end thereof; a pump cylinder means in said housing means; an externally actuated plunger reciprocable in said cylinder means to define therewith a pump chamber open at one end for the discharge of fuel during a pump stroke and for fuel intake during a suction stroke of said plunger; a valve controlled injection nozzle means operatively positioned in one end of said housing means; a discharge passage means connecting said pump chamber to said injection nozzle means; a solenoid actuated, poppet valve controlled passage means for effecting flow communication between said pump chamber and said supply/drain chamber and including a solenoid actuated poppet valve having a head with a stem extending therefrom journaled in said valve guide bore for reciprocable movement whereby said head is movable between an open position and a closed position relative to said valve seat, said stem having a reduced diameter stem portion next adjacent to said head which defines with said valve stem guide bore an annulus portion of said valve controlled passage means; a solenoid means operatively positioned in said housing means, said solenoid means including an armature operatively connected to said poppet valve, a spring means operatively positioned to normally bias said poppet valve to said open position; and a piston slidably journaled in said housing means concentric to said poppet valve with one end of said piston positioned to abut against said head of said poppet valve, the opposite end of said piston being in flow communication with said discharge passage means whereby said piston is operative to assist in holding said poppet valve in said closed position.

2. An electromagnetic unit fuel injector including a housing means having a pump cylinder means therein an externally actuated plunger reciprocable in said cylinder means to define therewith a pump chamber open at one end for the discharge of fuel during a pump stroke and for fuel intake during a suction stroke of said plunger; a fuel passage means in said housing means that is connectable to a source of fuel for the ingress or egress of fuel at a suitable supply pressure, a supply/drain chamber in flow communication with said fuel passage means, a valve stem guide bore in said housing means with a conical valve seat encircling said guide bore at the supply/drain chamber end thereof; a valve controlled injection nozzle means operatively positioned in one end of said housing means; a supply/discharge passage means including a discharge passage means connecting said pump chamber to said injection nozzle means; a solenoid actuated, poppet valve controlled passage means for effecting flow communication between said pump chamber and said supply/drain chamber via a portion of said supply/discharge passage means, said valve controlled passage means including a solenoid actuated poppet valve having a head with a stem extending therefrom journaled in said valve guide bore for reciprocable movement whereby said head is movable between an open position and a closed position relative to said valve seat, said stem having a reduced diameter stem portion next adjacent to said head which defines with said valve stem guide bore an annulus portion of said valve controlled passage means; a solenoid means operatively positioned in said housing means, said solenoid means including an armature operatively connected to said poppet valve and a spring means operatively positioned to normally bias said poppet valve to said open position; and a piston slidably journaled in said housing means concentric to said poppet valve with one end of said piston positioned to abut against said head of said poppet valve, the opposite end of said piston being in flow communication with said discharge passage means whereby said piston is operative to assist in holding said poppet valve in said closed position.

3. An electromagnetic unit fuel injector including a housing means having a fuel passage means connectable to a source of fuel for the ingress or egress of fuel at a suitable supply pressure, a supply/drain chamber in flow communication with said fuel passage means, a valve stem guide bore in said housing means with a conical valve seat encircling said guide bore at the supply/drain chamber end thereof; a pump cylinder means in said housing means; an externally actuated plunger reciprocable in said cylinder means to define therewith a pump chamber open at one end for the discharge of fuel during a pump stroke and for fuel intake during a suction stroke of said plunger; a valve controlled injection nozzle means operatively positioned in one end of said housing means; a supply/drain passage means including a discharge passage means connecting said pump chamber to said injection nozzle means and a solenoid actuated, poppet valve controlled passage means for effecting flow communication between said pump chamber and said supply/drain chamber, said valve controlled passage means including a solenoid actuated poppet valve having a head with a stem extending therefrom journaled in said valve guide bore for reciprocable movement whereby said head is movable between an open position and a closed position relative to said valve seat, said stem having a reduced diameter stem portion next adjacent to said head which defines with said valve stem guide bore an annulus portion of said valve controlled passage means; a solenoid means operatively positioned in said housing means, said solenoid means including an armature operatively connected to said poppet valve, a spring means operatively positioned to normally bias said poppet valve to said open position; and a piston slidably journaled in said housing means concentric to said poppet valve with one end of said piston positioned to abut against said head of said poppet valve, the opposite end of said piston being in communication with pressurized fuel in said discharge passage means whereby said piston is hydraulically moved in an axial direction whereby to assist in holding said poppet valve in said closed position when said solenoid assembly is energized.

4. An electromagnetic unit fuel injector according to any one of claims 1, 2 or 3 wherein said housing means further includes an internal wall means forming with said head of said poppet valve, when said poppt valve is moved from said closed position, a throttle orifice in the form of a flow annulus defining a portion of said supply/drain chamber whereby high pressure fuel in said annulus portion of said valve controlled passage means can act on said head to assist in effect more rapid opening movement of said poppet valve.

5. An electromagnetic unit fuel injector according to any one of claims 1, 2 or 3 wherein said plunger, said poppet valve and said piston are positioned in substantial coaxial alignment with respect to each other.

* * * * *